US007728261B2

(12) United States Patent
Helm

(10) Patent No.: US 7,728,261 B2
(45) Date of Patent: Jun. 1, 2010

(54) COOKING APPLIANCE

(75) Inventor: Peter Helm, Wolfenbuttel (DE)

(73) Assignee: MKN Maschinenfabrik Kurt Neubauer GmbH & Co. (DE)

( * ) Notice: Subject to any disclaimer, the term of this patent is extended or adjusted under 35 U.S.C. 154(b) by 1050 days.

(21) Appl. No.: 10/579,860

(22) PCT Filed: Nov. 24, 2004

(86) PCT No.: PCT/EP2004/013329

§ 371 (c)(1),
(2), (4) Date: May 17, 2006

(87) PCT Pub. No.: WO2005/052452

PCT Pub. Date: Jun. 9, 2005

(65) Prior Publication Data

US 2007/0084454 A1 Apr. 19, 2007

(30) Foreign Application Priority Data

Nov. 26, 2003 (DE) ..... 103 55 778

(51) Int. Cl.
*A21B 1/24* (2006.01)
*A21B 1/36* (2006.01)
*A21B 3/04* (2006.01)

(52) U.S. Cl. ..... 219/401; 126/20

(58) Field of Classification Search ..... None
See application file for complete search history.

(56) References Cited

U.S. PATENT DOCUMENTS

2006/0000821 A1* 1/2006 Gerola et al. ..... 219/401
2007/0187388 A1* 8/2007 Yamaguchi et al. ..... 219/401
2008/0078371 A1* 4/2008 Boscaino ..... 126/20

FOREIGN PATENT DOCUMENTS

| | | | |
|---|---|---|---|
| DE | 39 09 283 | C2 | 10/1990 |
| DE | 197 32 240 | C1 | 4/1999 |
| DE | 199 18 330 | A1 | 10/2000 |
| DE | 202 00 618 | U1 | 7/2002 |
| DE | 101 58 425 | C1 | 9/2003 |
| EP | 0 233 535 | | 8/1987 |

* cited by examiner

*Primary Examiner*—Joseph M Pelham
(74) *Attorney, Agent, or Firm*—Salter & Michaelson

(57) ABSTRACT

The invention relates to a cooking appliance (10) comprising a cooking chamber (11) with heating elements (12) and a water supply (30) that has a water outlet (33) and is fed by an outer water supply line (40). The water supply (30) is provided with at least one intermediate water storage tank (45) with a pre-determined inner volume (46) that can be filled with water and is fed by the outer water supply line. The filling and emptying of the inner volume (46) of the at least one intermediate water storage tank (45) can be temporarily blocked by means of a three-way valve or two-way valves. The water from the inner volume (33) of the at least one intermediate water storage tank (45) can be emptied via the water outlets (33) in order to generate steam in the cooking chamber (11). The emptying of said at least one intermediate water storage tank is especially periodical or clocked. The intermediate water storage tank can be embodied as a lifting cylinder that is filled and emptied by the lifting movement of a piston (48).

33 Claims, 4 Drawing Sheets

COOKING APPLIANCE

TECHNICAL FIELD

Figure 1:
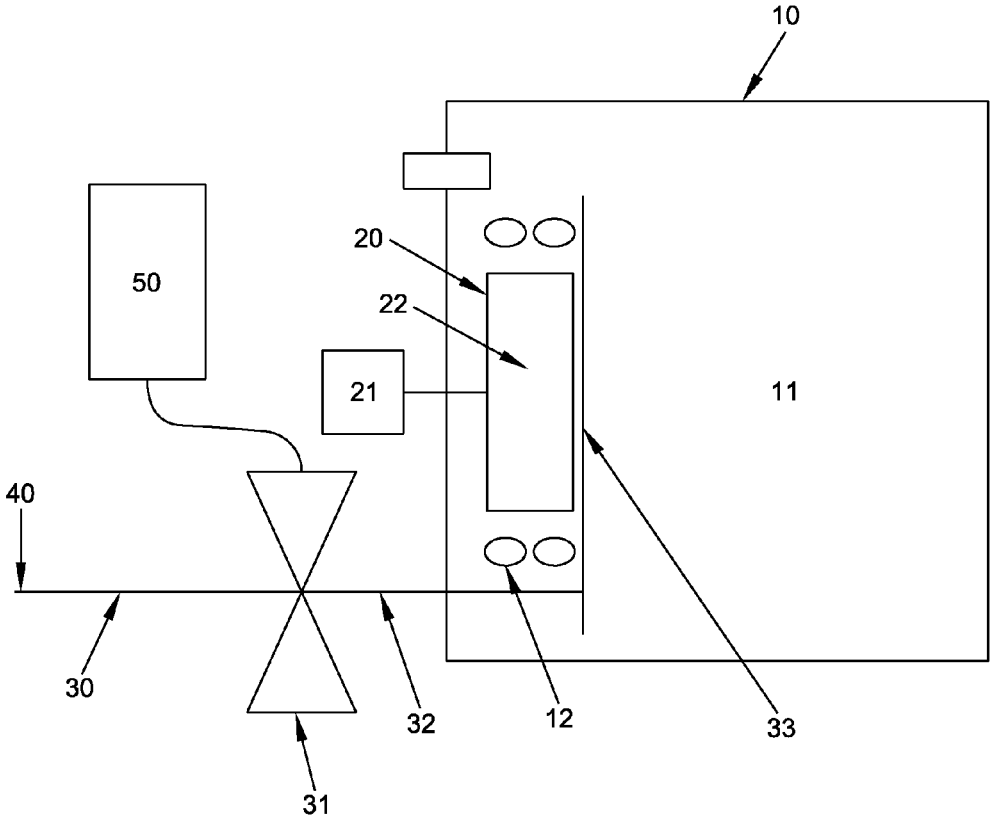

The invention relates to a cooking appliance comprising a cooking chamber having one or more heating elements and a water supply which is fed by an external water supply source and has at least one water outlet.

BACKGROUND OF THE INVENTION

To an increasing extent, cooking appliances are also being equipped with a steam generating system in order to improve the results of the cooking process with the help of the humid air thereby ensuing in the cooking chamber. Such cooking appliances are, for example, combination steamers, baking-ovens, steaming appliances or hot-air ovens. They serve, in particular, for the purposes of preparing food for consumption. It is preferred hereby that the steam be produced by injecting water directly into the cooking chamber. To this end, water is supplied to the cooking chamber and distributed therein in different forms and is thereby evaporated by the hot environment.

In accordance with the concepts known from DE 101 58 425 C1, DE 39 09 283 C2 or EP 0 233 535 B1 for example, water supply pipes are employed for this purpose, said pipes conveying the water to a point close to the hub of the fan wheel in a rotary blower. Due to the fact that the fan wheel is rotating about its hub, the water is, for example, fed from the hub to the impeller blades of the fan by centrifugal force and there, the water is decomposed into drops of as small a size as possible and these then evaporate in the hot atmosphere of the cooking chamber. The rotation of the fan wheel thus leads to the atomisation process.

It is also desirable for the rate of flow of the water being supplied to be regulated or controlled. To this end, DE 39 09 283 C2 describes a hot-air oven in which the water supply is equipped with a solenoid valve. Moreover, provision is made for the temperature in the exhaust air flue to be measured. The solenoid valve is thus operated for controlling the supply of water in dependence on the temperature-measured in the exhaust air flue. However, if the water flow is switched off completely, undersaturation and thus impairment of the cooked item can occur due to losses or absorption of the steam by the cooked item.

In order to avoid this effect, the users try to get round this disconnection process by not using the system.

Furthermore, a proposal is known from DE 202 00 618 U1 which enables the quantity of water to be reduced, this thereby avoiding the dangers ensuing if the flow of water is completely switched off. Here, the water supply is equipped with a controllable water dosage means for dosing the quantity of water flowing through the arrangement. The result of this is that the rate of flow of the water is no longer maintained at approximately the same level but is reduced after reaching saturation. This reduction enables a substantial saving of energy to be achieved during the cooking process.

As in DE 39 09 283 C2, adjustable solenoid valves are also employed in other cases in order to switch on or switch off the flow of water to the cooking chamber. These valves are usually regulated by an electronic control system. The rate of flow is comparatively small and amounts in practice, to between 3 and 25 litres per hour, corresponding approximately to 1 $cm^3/s$ to 7 $cm^3/s$ in dependence on the size of the oven.

However, there are large fluctuations of pressure in the public water supply network and the pressure varies very widely from place to place. In practice, the pressure in the pipes may be between 0.2 and 1.0 MPa, i.e. between about 2 and 10 bar.

However, a constant rate of flow would be a prerequisite for maintaining a uniform and reproducible quantity of steam and thus obtaining reproducible results from the cooking process. If the rate of flow for generating the steam varies, this has an effect on the temperature in the cooking chamber since substantial quantities of energy must be expended in order to evaporate the amount of water that has been introduced. Too large a variation in the rate of flow means a large change in value of a disturbance variable which rapidly leads to excessive demands on the temperature regulator. A deviation from the preferred temperature, particularly in the steam mode of operation, then leads to the results of the cooking process being unsatisfactory. In the event that the amount of water supplied is too small, the amount of steam produced may be so low that this will have negative effects on the result of the cooking process.

In the present state of the art for example, mechanical water pressure regulators are employed in order to maintain the variable water input pressure at a constant initial value. However, these pressure regulators have the disadvantage that the initially set pressure values alter during the operational period and, due to their method of construction, they exhibit inertia which prevents rapid readjustment of the pressure in the face of a rapidly changing input pressure.

Furthermore, the regulators and the valves being utilised need to be initially adjusted.

Moreover, a disadvantage of the state of the art is that the initially set rate of flow can only be altered to a limited extent by the electronic control system. The rate of flow can in fact be reduced by applying clock pulses to the solenoid valve, but it cannot be increased without further measures.

OBJECTS OF THE INVENTION

The object of the invention is it to propose a cooking appliance in which it is possible to provide a better dosage process.

SUMMARY OF THE INVENTION

This object is achieved in the case of a cooking appliance in that one or more intermediate water storage reservoirs having a predetermined interior volume that is adapted to be filled with water are provided in the water supply, in that the intermediate water storage reservoir or reservoirs is fed by the external water supply source, in that the interior volume of the intermediate water storage reservoir or reservoirs is adapted to be intermittently blocked in regard to the filling process and intermittently blocked in regard to the emptying process, and in that the water from the interior volume of the intermediate water storage reservoir or reservoirs is adapted to be emptied into the cooking chamber via the water outlet or the water outlets for the purposes of generating steam.

By virtue of such a conception, it is simultaneously possible to produce dosage of a quantity for which no adjustment of any sort is needed, which supplies the same rate of flow for different input pressures and enables a variable rate of flow in accord with demand.

This applies, in particular, when there is provided a control or regulating device which initiates periodic or clocked emptying of the interior volume. Hereby, the periodic or clocked emptying process can be effected in constant time steps. In many cases however, a regulated or controlled variable clocking process could also be effected. A change of the rate of flow into the cooking chamber can thus be effected in a particularly simple and uniform manner.

Hereby, it is especially particularly preferred that the intermediate water storage reservoir be in the form of a swept cylinder whose interior volume is adapted to be emptied by a piston.

It is of further advantage if the intermediate water storage reservoir is adapted to be intermittently blocked in regard to overfilling and intermittently blocked in regard to emptying by means of a multi-port distributing valve.

If one considers the concept of the invention more closely, then it can be seen that the very pressure-dependent and incalculable supply of water from the external water supply source is separated by an intermediate water storage reservoir from the actual water supply to the cooking chamber. In each case, the intermediate water storage reservoir is completely filled with water from the external water supply source and is then separated from this external water supply source. The interior volume of the intermediate water storage reservoir, which is now filled with an exactly fixed and accurately defined amount of water, is then emptied into the cooking chamber for generating the steam. The volume of water that is supplied for generating the steam is thus accurately calculable and predictable.

The speed of the water supply, measured for instance in $cm^3/s$, can now be precisely determined by appropriate clocking of this emptying process, namely, completely independently of the pressure actually existing in the external water supply source or the use of expensive and complicated dosing appliances.

The size of the interior volume is now so small that although appropriate clocking does indeed lead to a discrete rate of flow, it is nevertheless an almost continuous rate of flow. Moreover, this rate of flow can still be controlled in that the clock rate is raised or lowered in order to supply greater or lesser volumes of water.

This smoothing process can be increased still more by the use of suitably laid hoses in the water supply. If necessary, it would even be conceivable to connect a plurality of intermediate water storage reservoirs in parallel and operate them alternately in order to obtain a still greater smoothing effect.

Instead of constructing the arrangement in accordance with the invention from swept cylinders, pistons and 3/2-port distributing valves, another structure, using perhaps a circular piston arrangement remotely similar to a Wankel engine, could also be envisaged. Alternatively, it is also conceivable to make use of intermediate water storage reservoirs having flexible walls and/or diaphragms which empty the interior volume into the cooking chamber by means of suitable mechanisms.

It is also possible for the water supply to comprise at least two water supply pipes which run in parallel at least over sections thereof, each of the water supply pipes including one or more intermediate water storage reservoirs having a predetermined interior volume that is adapted to be filled with water. It is particularly preferred hereby that a respective intermediate water storage reservoir of each of the two water supply pipes be combined with one another in such a manner that they form a common intermediate water storage reservoir, whereby its interior accommodates the two interior volumes which are separated by the piston bearing the water such that the movement of the piston simultaneously leads to an emptying of the interior volume of the one intermediate water storage reservoir and to the filling of the associated other interior volume of the other intermediate water storage reservoir.

In this way, an alternate filling process via two branches of the water supply can be established in a particularly reliable and constructionally simple manner, whereby moreover, it is particularly expedient in terms of energy that the movement of a piston can be used for simultaneously emptying the one intermediate storage reservoir and filling the other intermediate storage reservoir.

Instead of the 3/2-port distributing valves, a plurality of conventional 2/2-port distributing valves could also be employed, namely, both in the case of the solution using just one intermediate water storage reservoir and that using a plurality thereof.

DETAILED DESCRIPTION OF THE DRAWINGS

Figure 2:
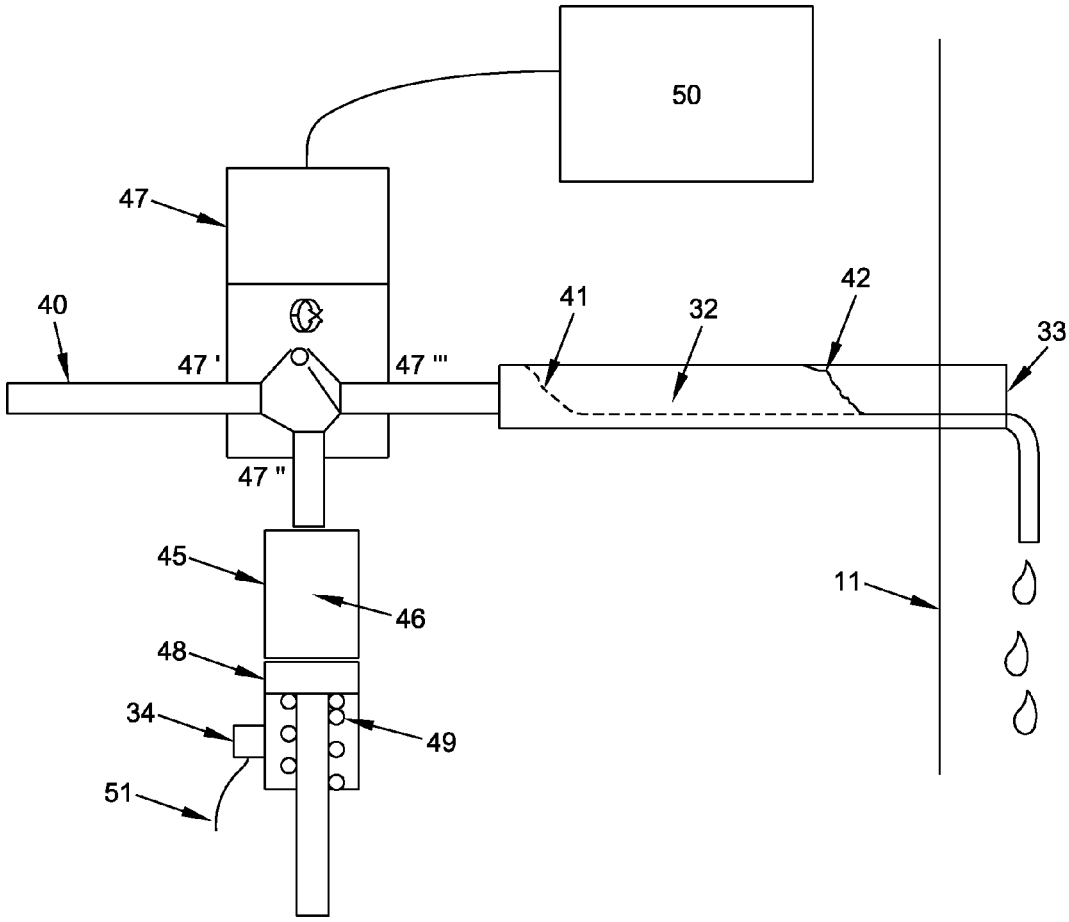
Figure 3:
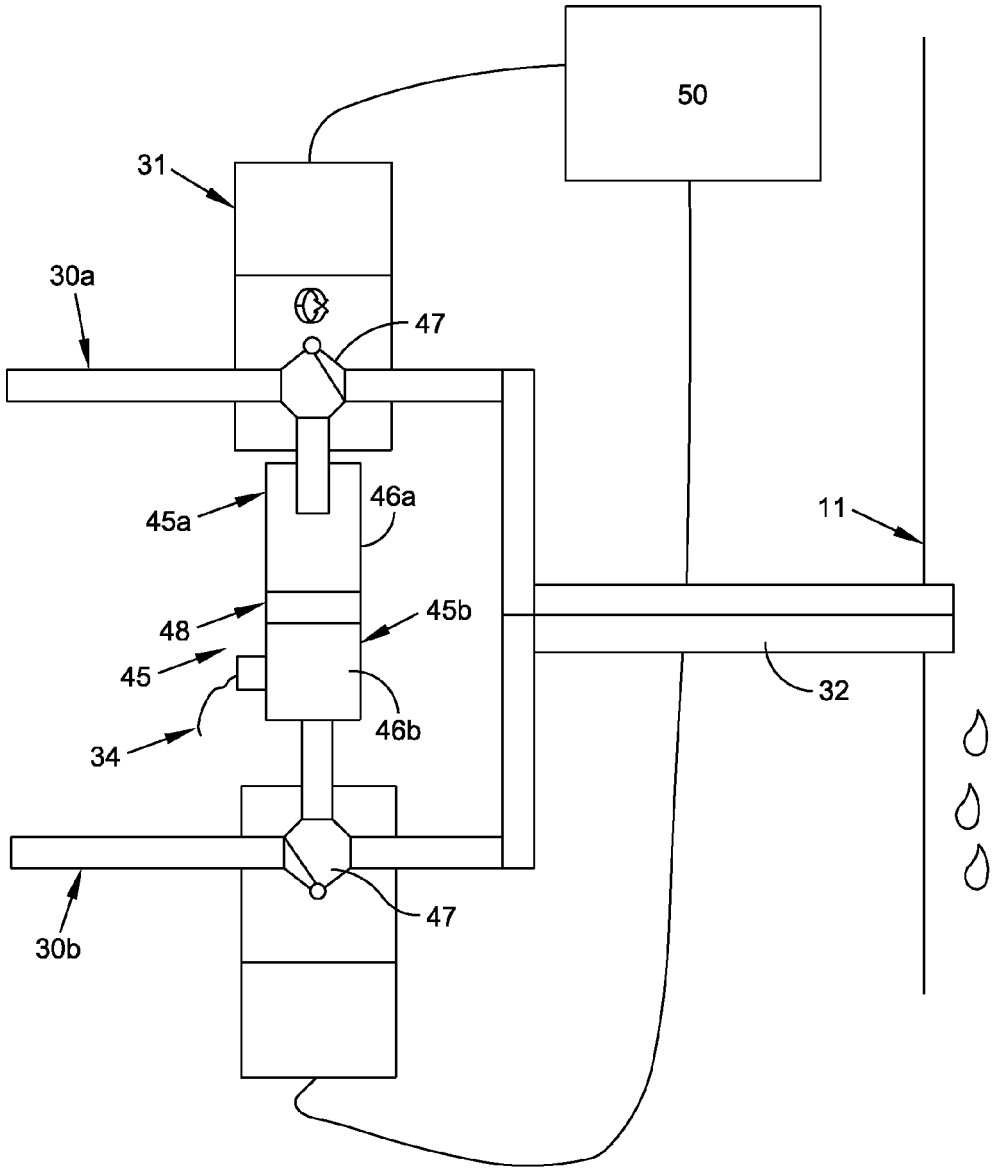
Figure 4:
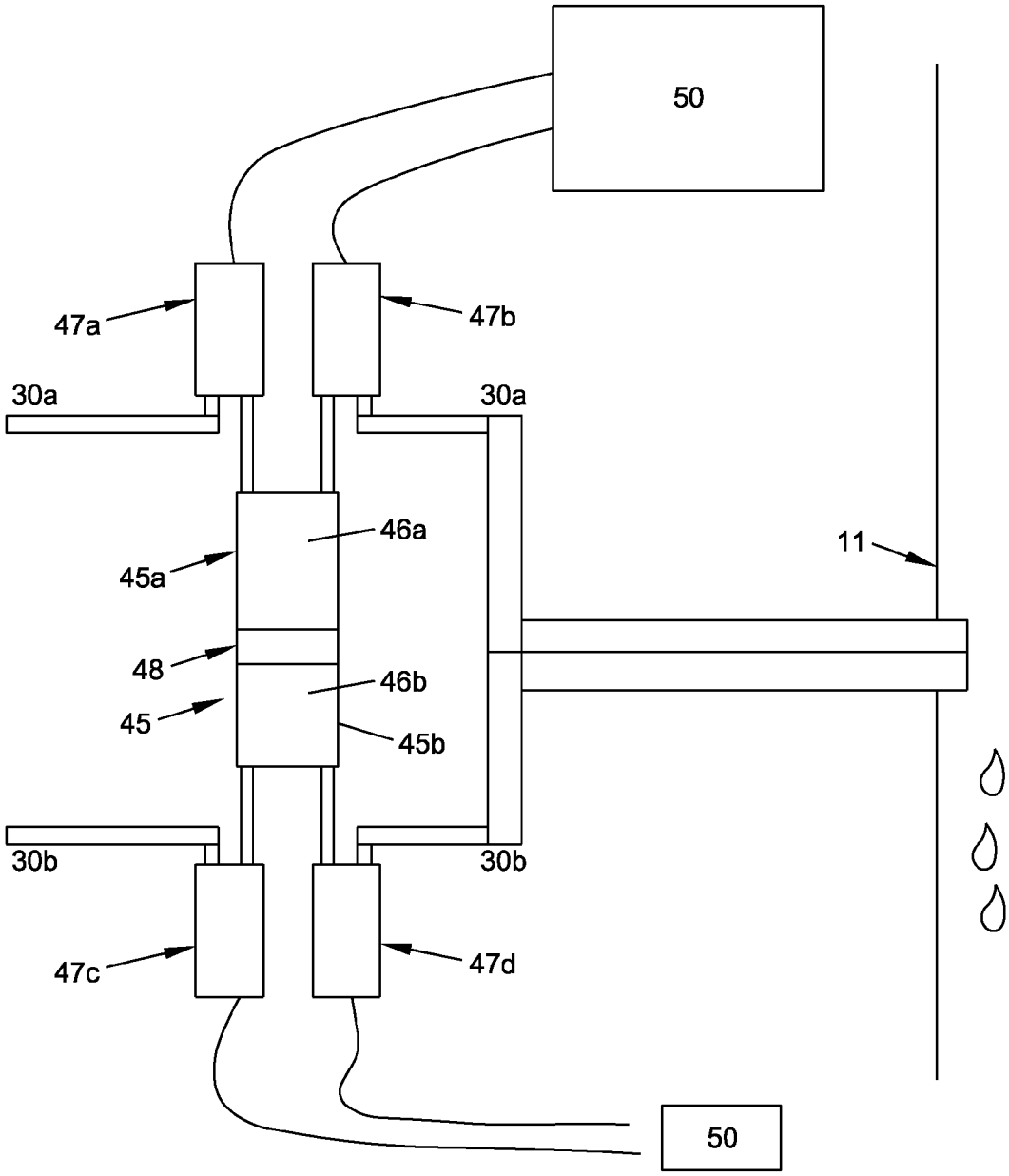

An exemplary embodiment of the invention will be described in more detail hereinafter with the aid of the accompanying drawing. Therein:

FIG. 1 shows a schematic overview of a cooking appliance including a water supply;

FIG. 2 a schematic illustration of a water dosage system in a cooking-appliance in accordance with the invention;

FIG. 3 a schematic illustration of an alternative embodiment for a water dosage system in a cooking appliance in accordance with the invention; and FIG. 4 a schematic illustration of a third alternative embodiment of a water dosage system in a cooking appliance in accordance with the invention.

DETAILED DESCRIPTION OF THE PREFERRED EMBODIMENT

A cooking appliance, for example a combination steam cooker, a baking-oven or some other hot-air appliance, is schematically illustrated in FIG. 1 as seen from the user's viewpoint. This cooking appliance 10 incorporates a cooking chamber 11. A heating element 12 is provided in the cooking chamber 11 on the left-hand side, although only two turns thereof are perceptible in this schematically illustrated cross section. The heating of the cooking chamber 11 can be effected either by means of electrical heating elements 12 or else by means of heating elements 12 in the form of heat exchanger pipes through which a hot medium flows. Other appliances for the production of heat are also useable as heating elements 12.

A blower 20 is provided in order to distribute the heat produced by the heating element 12 or the air heated thereby uniformly through the cooking chamber 11. This blower 20 comprises a fan motor 21 which drives a radial flow fan wheel 22 in the cooking chamber 11. The radial flow fan wheel 22 is located within the heating element 12 and is surrounded thereby in the radial direction. As a rule, the heating elements 12—whether electrical or in the form of heat exchanger pipes—are located in the direct flow path of the radial flow fan wheel 22. Other arrangements are possible, although this has proved its worth.

A further essential element of the combination steamer incorporating a steam generating system in accordance with the invention is a water supply 30. This feeds the water from an external water supply source 40 into the cooking chamber 11 via a water quantity dosing means 31, which is described in more detail in FIG. 2, and a water supply pipe 32. The water is discharged at the water outlet 33, namely, in the vicinity of the radial flow fan wheel 22.

The discharge at the water outlet 33 of the water supply 30 is pressure-less or free. The water now reaches an atomisation element (not illustrated).

In this way, very small water droplets develop in the atmosphere of the gas in the cooking chamber 11, these droplets then rapidly evaporate and thus produce the desired steam. The steam is distributed with the other gases throughout the entire cooking chamber 11.

Now, it was in order to precisely define the volume of water delivered to the cooking chamber 11 from the water supply 30 via the water supply pipe 32 and the water outlet 33 or the volume of water delivered to the cooking chamber per unit of time and thus to have an accurate knowledge of the quantity of water which has been supplied, that the arrangement of this water supply 30 in accordance with the invention was developed, this being illustrated in detail in FIG. 2.

To the left of FIG. 2, one sees the entry point of an external water supply source 40 to the cooking appliance, thus for example, the water supply pipe existing in the building. The water from this external water supply source 40 enters an intermediate water storage reservoir 45 which is formed here by a cylinder. In the cylinder of the intermediate water storage reservoir 45, there is an interior volume 46 which can be filled by the water from the external water supply source 40.

There is a valve 47 between the entry point of the external water supply source 40 and the intermediate water storage reservoir 45. This valve 47 can be closed at its entrance port 47' in order to prevent more water being supplied to the intermediate water storage reservoir 45 from the external water supply source 40 and likewise to prevent the interior volume 46 being emptied in the direction of the external water supply source 40.

Here, the valve 47 is in the form of a 3/2-port distributing valve. The second exit port 47''' of the valve 47 leads into the above mentioned water supply pipe 32, here a hose pipe, which leads to the cooking chamber 11, although only the side wall of the cooking chamber is perceptible here in FIG. 2. The water supply pipe 32 also ends here in a water outlet 33 from which the water enters the cooking chamber 11, usually in the vicinity of the radial flow fan wheel 22, compare the description with respect to FIG. 1.

In the cylinder of the intermediate water storage reservoir 45, there is a piston 48 which can reduce or increase the interior volume 46 by virtue of its movement or can discharge the quantity of water contained in the interior volume 46 through the valve 47.

The valve 47 is preferably a solenoid operated 3/2-port distributing valve 47, to whose first exit port 47'' there is attached a working cylinder in the form of an intermediate water storage reservoir 45 having the defined interior volume 46. If the valve 47 is now opened, water from the public water supply network acting as an external water supply source 40 flows through the connecting pipe, the valve entrance port 47' and the first valve exit port 47'' into the intermediate water storage reservoir 45. The piston 48 in the working cylinder is driven out as a result of the water pressure applied thereto. Now if the current flow is interrupted, the valve 47 closes the water entrance port 47' and the water can be pushed, by spring action 49 on the piston 48 for example, from the cylinder into the second, now open, exit port 47''' of the solenoid valve 47. The water is transported from this exit port 47''' by means of the hose pipe 32 to the cooking chamber 11. From there, it can then be led to the fan wheel 22 where the steam is produced.

This means, that a defined quantity of water, namely, the cylinder volume, is advanced for each time-limited opening of the 3/2-port distributing valve 47. A defined quantity of water can now be advanced with the help of the timing waveform used for opening the valve 47. A variable input pressure now has no influence at all on the quantity of water being advanced. This only depends on the interior volume 46 of the cylinder and the voltage clocking signal. A calibration process for the quantity of water is no longer necessary since the rate of flow can be defined by fixed time intervals in a preferably electronically operating regulating or control device 50. Rathermore, it is now possible for the rate of flow to be changed in a directed manner by adjusting the time intervals. This makes sense at the beginning of a cooking process for example, in order to produce a lot of steam as quickly as possible. In subsequent operation, the rate of flow can be reduced should steam saturation be reached in the cooking chamber 11, such as in the oven muffle.

The invention enables the water to be advanced periodically. If the time period is selected to be sufficiently short then there is a practically continuous flow of water. A continuous flow of water can be obtained by laying the hose in the water supply pipe 32 to the cooking chamber 11 in a suitable manner. For the temperature regulator, this means a smaller value of the disturbance variable. If the hose of the water supply pipe 32 having a predetermined internal diameter is laid horizontally over a path whose length is at least so long that the volume of the hose is greater than the interior volume 46 of the working cylinder of the intermediate water reservoir 45, then the available volume of the hose will nearly be filled up by the periodic operation of the piston 48. At the end however, due to the free discharge at the water outlet 33 and the relatively small rate of flow, the water level is always equally high, namely, lower than the cross section of the hose, so that a continuous flow of water will ensue. The filling of the hose always oscillates between positions 41 and 42.

If a suitable component, a Hall sensor 34 for example, is attached to the working cylinder of the intermediate water storage reservoir 45 and a magnet is located in the piston 48 and if the measured data is transmitted to the regulating or control device 50 over a schematically indicated line 51, then the electronic regulating or control device can control the functioning of the water quantity dosage means 31 and, if necessary, provide a functioning-error message to the operator (shortage of water).

In another embodiment of the invention which is illustrated in FIG. 3, most of the elements are comparable to the solution of the embodiment in FIG. 2.

As can be seen, one difference which is immediately apparent at first glance is that the water supply is effected through two water supply pipes 30*a* and 30*b* which run in parallel as far as the flow is concerned. These can both be fed from the same reservoir source for instance. There are also provided two intermediate water storage reservoirs 45*a* and 45*b* which are combined in a common container and have respective interior volumes of 46*a* and 46*b*. Each of the two intermediate water storage reservoirs 45*a* and 45*b* is associated with a different one of the respective water supply pipes 30*a* and 30*b*. The two interior volumes 46*a* and 46*b* are separated by one and the same piston 48. A movement of the piston 48 now leads to one of the two interior volumes 46*a* or 46*b* being emptied, whereas the other is filled.

This movement can be controlled or regulated in like manner to the opening of the valves 47 by the regulating or control device 50 so that the supply of the contents of the two intermediate water storage reservoirs 45*a*, 45*b* to the water supply pipe 32 is then controlled in such a way that the latter supplies the water in a practically uniform and constant manner, as is so desired.

An alternative is illustrated in FIG. 4, this being suitable both for the variant of FIG. 2 and that of FIG. 3, although it is illustrated here in connection with the version of FIG. 3.

The difference consists in that instead of a 3/2-port distributing valve 47, a plurality of 2/2-port distributing valves, in this case namely, two, are arranged in each of the two water supply pipes 30*a*, 30*b*. By using distributing valves of this type, an unintentional flow of water through the valve to the cooking chamber without contact with the intermediate water storage reservoir during the control phase of the valve can be prevented with yet greater certainty.

While this disclosure has been particularly shown and described with references to preferred embodiments thereof, it will be understood by those skilled in the art that various changes in form and details may be made therein without departing from the spirit and scope of the disclosure as defined by the appended claims.

LIST OF REFERENCE SYMBOLS

10 cooking appliance
11 cooking chamber
12 heating element
20 blower
21 fan motor of the blower
22 radial flow fan wheel
30 water supply
30*a* water supply pipe
30*b* water supply pipe
31 water quantity dosage means
32 water supply pipe to the cooking chamber
33 water outlet in the cooking chamber
34 sensor on the intermediate water storage reservoir
40 external water supply
41 position for the filling of the hose
42 position for the filling of the hose
45 intermediate water storage reservoir
45*a* intermediate water storage reservoirs
45*b* intermediate water storage reservoirs
46 interior volume
46*a* interior volume
46*b* interior volume
47 valve
47' entrance port of the valve
47" first exit port of the valve
47''' second exit port of the valve
47*a* valve
47*b* valve
47*c* valve
47*d* valve
48 piston
49 spring action
50 control or regulating device
51 line from the sensor to the control and regulating device

What is claimed is:

1. A cooking appliance comprising:

a cooking chamber, one or more heating elements, a water supply which is fed from an external water supply source, a water supply pipe having a water outlet coupled to the cooking chamber, one or more intermediate water storage reservoirs having a predetermined interior volume that is adapted to be filled with water provided from the water supply, the intermediate water storage reservoir or reservoirs being fed by the external water supply source, a multi-port distributing valve having an entrance port coupled to said water supply, an exit port coupled to said storage reservoir, an exit port coupled to said water supply pipe, and operating for filling and emptying the intermediate water storage reservoir, the interior volume of the intermediate water storage reservoir or reservoirs being adapted to be controlled by said multi-port distributing valve to be intermittently blocked in regard to the filling and intermittently blocked in regard to the emptying, and the water from the interior volume of the intermediate water storage reservoir or reservoirs being adapted to be emptied into the cooking chamber via the water outlet for the purposes of generating steam.

2. A cooking appliance in accordance with claim 1, wherein there is provided a control or regulating device which initiates periodic or clocked emptying of the interior volume.

3. A cooking appliance in accordance with claim 1, wherein the intermediate water storage reservoir comprises a swept cylinder whose interior volume is adapted to be emptied by a piston.

4. A cooking appliance in accordance with claim 2, wherein the multi-port distributing valve is a 3/2-port distributing valve which is controlled electrically by the control and regulating device.

5. A cooking appliance in accordance with claim 1, wherein the emptying of the interior volume of the intermediate water storage reservoir is realized by a piston which periodically discharges the water in a swept cylinder.

6. A cooking appliance in accordance with claim 5, wherein the piston of the swept cylinder is equipped with a spring in order to push the water into the cooking chamber when the cylinder is opened at the cooking chamber side.

7. A cooking appliance in accordance with claim 1, wherein the rate of flow for the generation of the steam is adapted to be varied by a control and regulating device by means of a change in timing of a clock rate of the control and regulating device.

8. A cooking appliance in accordance with claim 1, wherein the intermediate water storage reservoir is connected by a hose-like water supply pipe to the cooking chamber and a pre-determined length of the hose converts a periodically varying rate of flow into a continuous rate of flow.

9. A cooking appliance in accordance with claim 1, wherein a sensor monitors the emptying, by the displacement of a piston.

10. A cooking appliance in accordance with claim 1, wherein the water supply comprises at least two water supply pipes which run in parallel in sections thereof, and each of the water supply pipes has one or more intermediate water storage reservoirs having a respective predetermined interior volume that is adapted to be filled with water.

11. A cooking appliance in accordance with claim 10, wherein respective intermediate water storage reservoirs of the two water supply pipes are combined with one another in such a manner that they form a common intermediate water storage reservoir, whereby its interior accommodates the two interior volumes which are separated by a piston that discharges the water in such a manner that the movement of the piston simultaneously leads to an emptying of the interior volume of the one intermediate water storage reservoir and to the filling of the other associated interior volume of the other intermediate water storage reservoir.

12. A cooking appliance in accordance with claim 11, wherein the intermediate water storage reservoir or reservoirs are adapted to be blocked by means of a plurality of two/two-port distributing valves in alternating manner in regard to the filling and in regard to the emptying.

13. The method of claim 1 wherein the rate of flow for the generation of the steam is adapted to be varied by a control and regulating device by means of a change in timing of a clock rate of the control and regulating device.

14. A cooking appliance comprising:

a cooking chamber;

at least one heating element iii the cooking chamber;

a water supply which is fed from a water supply source;

a water outlet pipe that terminates at a water outlet that is disposed within said cooking chamber;

said water supply including at least two separate water supply pipes;

at least two intermediate water storage reservoirs each having respective interior volumes adapted to be filled with water from said respective water supply pipes;

at least two multi-port distributing valves associated respectively with the at least two intermediate water storage reservoirs for respectively controlling the filling and emptying of said intermediate water storage reservoirs;

the water from the respective interior volumes of the intermediate water storage reservoirs adapted to be emptied into the cooking chamber via the water outlet for the purpose of generating steam.

15. The cooking appliance of claim 14 wherein said at least two intermediate water storage reservoirs are combined in a common container and are separated by a piston.

16. The cooking appliance of claim 15 including an electrical control device for controlling said valves for providing periodic emptying of the interior volumes.

17. The cooking appliance of claim 16 wherein each of the multi-port distributing valves is a 3/2-port distributing valve which is controlled by said electrical control device.

18. The cooking appliance of claim 14 wherein the two multi-port distributing valves have an exit port that is connected together and coupled to said water outlet.

19. The cooking appliance of claim 14 including four multi-port distributing valves arranged in pairs that are respectively associated with said at least two intermediate water storage reservoirs.

20. The cooking appliance of claim 19 wherein each of the multi-port distributing valves is a 2/2-port distributing valve, the intermediate water storage reservoirs being adapted to be blocked by means of said 2/2-port distributing valves in an alternating manner in regard to the filling and emptying of the intermediate water storage reservoirs.

21. A cooking appliance comprising:

a cooking chamber;

at least one heating element in the cooking chamber;

a water supply which is fed from a water supply source;

a water supply pipe having a water outlet coupled to the cooking chamber;

at least one intermediate water storage reservoir having a predetermined interior volume that is adapted to be filled with water provided from the water supply;

a least one distributing valves associated respectively with the at least one intermediate water storage reservoir for respectively controlling the filling and emptying of said intermediate water storage reservoir;

said at least one distributing valve having an entrance port coupled to said water supply, an exit port coupled to said storage reservoir and an exit port coupled to said water supply pipe, the interior volume of the intermediate water storage reservoir being adapted to be controlled by said at least one distributing valve;

said at least one distributing valve operating for successively filling and emptying the intermediate water storage reservoir so as to advance the predetermined interior volume of water;

the water from the interior volume of the intermediate water storage reservoir adapted to be emptied into the cooking chamber via the water outlet for the purpose of generating steam.

22. The cooking appliance of claim 21 including an electrical control device for controlling the distributing valve so as to initiate clocked emptying of the interior volume.

23. The cooking appliance of claim 22 wherein the control device is controlled to effect the clock rate of the device to, in turn, control the overall volume of water coupled to the cooking chamber.

24. The cooking appliance of claim 21 wherein the intermediate water storage reservoir comprises a swept cylinder whose interior volume is adapted to be emptied by a piston.

25. The cooking appliance of claim 24 including a sensor for detecting displacement of the piston.

26. The cooking appliance of claim 21 wherein the rate of flow for the generation of the steam is adapted to be varied by a control and regulating device by means of a change in timing of a clock rate of the control and regulating device.

27. The cooking appliance of claim 21 wherein the interior volume of the intermediate water storage reservoir is adapted to be controlled by said distributing valve to be intermittently blocked in regard to the filling and intermittently blocked in regard to the emptying.

28. The cooking appliance of claim 21 wherein the water supply comprises at least two water supply pipes which run next to each other in sections thereof, and each of the water supply pipes has one or more intermediate water storage reservoirs having a respective predetermined interior volume that is adapted to be filled with water.

29. The cooking appliance of claim 28 wherein respective intermediate water storage reservoirs of the two water supply pipes are combined with one another in such a manner that they form a common intermediate water storage reservoir, whereby its interior accommodates the two interior volumes which are separated by a piston that discharges the water in such a manner that the movement of the piston simultaneously leads to an emptying of the interior volume of the one intermediate water storage reservoir and to the filling of the other interior volume of the other intermediate water storage reservoir.

30. The cooking appliance of claim 29 wherein the intermediate water storage reservoir or reservoirs are adapted to be blocked by means of a plurality of two/two-port distributing valves in alternating manner in regard to the filling and in regard to the emptying.

31. A method of controlling the generation of steam at the water outlet in the cooking chamber of a cooking appliance comprising:

providing at least one intermediate water storage reservoir having a predetermined interior volume that is adapted to be filled with water provided from a water supply;

controlling the water from the water supply by means of at least one distributing valve associated respectively with the at least one intermediate water storage reservoir for respectively controlling the filling and emptying of said water storage reservoir;

in a first state of the distributing valve, opening the distributing valve so as to fill the interior volume of the water storage reservoir from the water supply;

in a second state of the distributing valve, subsequently opening the distributing valve emptying the interior volume of water from the water storage reservoir via a water outlet to the cooking chamber;

whereby the water from the interior volume of the intermediate water stoner reservoir is emptied into the cooking chamber via the water outlet for the purpose of generating steam.

32. The method of claim 31 including operating the distributing valve for filling and emptying the intermediate water storage reservoir, the interior volume of the intermediate water storage reservoir being adapted to be controlled by said distributing valve to be intermittently blocked in regard to the filling and intermittently blocked in regard to the emptying.

33. The method of claim 31 wherein the emptying of the interior volume of the intermediate water storage reservoir is realized by a piston which periodically discharges the water in a swept cylinder.

* * * * *